US010829334B2

(12) United States Patent
Yokoo et al.

(10) Patent No.: US 10,829,334 B2
(45) Date of Patent: Nov. 10, 2020

(54) STORAGE BAG AND SHEET HANDLING APPARATUS

(71) Applicant: GLORY LTD., Himeji (JP)

(72) Inventors: Tomohiro Yokoo, Himeji (JP); Youichi Takemura, Himeji (JP); Eiki Yamamoto, Himeji (JP)

(73) Assignee: Glory Ltd., Hyogo (JP)

( * ) Notice: Subject to any disclaimer, the term of this patent is extended or adjusted under 35 U.S.C. 154(b) by 22 days.

(21) Appl. No.: 16/316,423

(22) PCT Filed: Jun. 21, 2017

(86) PCT No.: PCT/JP2017/022887
§ 371 (c)(1),
(2) Date: Jan. 9, 2019

(87) PCT Pub. No.: WO2018/012228
PCT Pub. Date: Jan. 18, 2018

(65) Prior Publication Data

US 2019/0248616 A1 Aug. 15, 2019

(30) Foreign Application Priority Data

Jul. 11, 2016 (JP) ..... 2016-136921

(51) Int. Cl.
*B65H 31/26* (2006.01)
*G07F 19/00* (2006.01)
*G07D 13/00* (2006.01)

(52) U.S. Cl.
CPC ..... *B65H 31/26* (2013.01); *G07D 13/00* (2013.01); *G07F 19/00* (2013.01)

(58) Field of Classification Search
CPC ..... B65H 31/26; G07D 13/00; G07D 11/12; G07F 19/00; E05G 7/00
See application file for complete search history.

(56) References Cited

U.S. PATENT DOCUMENTS 6,231,237 B1 5/2001 Geller
2014/0254960 A1* 9/2014 Tanaike ..... B65D 33/1691 383/211

FOREIGN PATENT DOCUMENTS

| | | | |
|---|---|---|---|
| DE | 9212634 | U1 | 11/1992 |
| EP | 3407751 | A1 | 12/2018 |
| GB | 2394939 | A | 12/2004 |
| JP | 47-27989 | Y1 | 8/1972 |

(Continued)

OTHER PUBLICATIONS

Written Opinion of the International Searching Authority (International Application No. PCT/JP2017/022887) (7 pages—dated Aug. 22, 2017).

(Continued)

*Primary Examiner* — David H Bollinger
(74) *Attorney, Agent, or Firm* — Renner, Kenner, Greive, Bobak, Taylor & Weber

(57) ABSTRACT

A storage bag (for example, a banknote storage bag 34, 34*p*, 34*q*, 34*r*, and 34*s*) mounted to a sheet handling apparatus (for example, a banknote handling machine 10) and configured to store sheets handled by the sheet handling apparatus includes an upper end at which an opening is provided, and a peripheral length of an internal space of the storage bag at a position where the opening is provided is the maximum size.

9 Claims, 8 Drawing Sheets

(56) References Cited

FOREIGN PATENT DOCUMENTS

| | | | |
|---|---|---|---|
| JP | 61-30606 | U | 2/1986 |
| JP | 2001-283278 | A | 10/2001 |
| JP | 2010-247851 | A | 11/2010 |
| JP | 2011-118651 | A | 6/2011 |
| JP | 2014-174581 | A | 9/2014 |

OTHER PUBLICATIONS

Supplementary European Search Report dated Feb. 11, 2020.

* cited by examiner

STORAGE BAG AND SHEET HANDLING APPARATUS

TECHNICAL FIELD

The present invention relates to a storage bag in which sheets such as banknotes are stored, and a sheet handling apparatus to which such a storage bag can be detachably mounted.

BACKGROUND ART

As a banknote handling machine for performing various processes such as deposit processing and dispense processing of banknotes, there has been conventionally used one in which the banknotes taken in into a housing are stored in a storage bag such as a pouch bag. As such a banknote handling machine, for example, one disclosed in Japanese Patent Application Laid-Open No. 2014-174581 (JP2014-174581A) and the like is conventionally known. More specifically, Japanese Patent Application Laid-Open No. 2014-174581 discloses a cash accounting apparatus installed in a back office area of a store such as a supermarket so that a storage bag for storing banknotes can be detachably mounted to the cash accounting apparatus and the banknotes deposited in the cash accounting apparatus are stored in the storage bag.

SUMMARY OF THE INVENTION

The conventional storage bag has a substantially rectangular shape, and a lateral width of a side surface of the storage bag is about the same size from the opening to the bottom. However, if such a storage bag is used, there is a problem that the banknotes stored in the storage bag in a stacked state tend to collapse. More specifically, in order to ensure that the banknotes are stored in the storage bag, it is necessary to make the opening provided at an upper end of the storage bag as large as possible, but if the size of the opening is increased, the lateral width of the storage bag also becomes large. When the lateral width of the storage bag is much larger than the length of the banknote in the longitudinal direction, there is a possibility that the banknotes collapse inside the storage bag when a plurality of banknotes is stored in the storage bag in a stacked state.

The present invention has been made in view of these points, and an object of the present invention is to provide a storage bag capable of preventing banknotes stored in a stacked state from collapsing. Another object of the present invention is to provide a sheet handling apparatus which can store banknotes in the storage bag in such a manner that the banknotes in a stacked state are not collapsed as much as possible.

A storage bag of the present invention mounted to a sheet handling apparatus and configured to store sheets handled by the sheet handling apparatus includes: an upper end at which an opening is provided; and a peripheral length of an internal space of the storage bag at a position where the opening is provided is the maximum size.

In the storage bag of the present invention, a plurality of sheets may be stored in the storage bag in a stacked state.

In the storage bag of the present invention, the peripheral length of the internal space may decrease as a distance from the opening increases.

In the storage bag of the present invention, a lateral width of a side surface of the storage bag may be the maximum size at the position where the opening is provided, and the lateral width of the side surface of the storage bag may decrease as a distance from the opening increases.

In the storage bag of the present invention, a reinforcing unit for reinforcing a side surface of the storage bag may be provided in the vicinity of the opening, and the peripheral length of the internal space at a position where the reinforcing unit is provided may be the same length.

In the storage bag of the present invention, the storage bag may have a substantially rectangular shape, and the internal space may be formed by adhering an internal surface of a portion near an edge of the storage bag.

In the storage bag of the present invention, the storage bag may include a first portion which is provided on a side close to the opening and the peripheral length of the internal space decreases as a distance from the opening increases, and a second portion which is provided on a side farther from the opening than the first portion and having a constant peripheral length of the internal space.

A sheet handling apparatus of the present invention to which a storage bag as described above is detachably mounted includes: a pair of left and right holding members configured to hold a portion of the storage bag in the vicinity of the opening; and a platform on which at least a part of the storage bag held by the holding members is placed, the platform being movable in a substantially vertical direction, and a distance between the holding members when holding the storage bag is larger than a width of the platform.

The sheet handling apparatus of the present invention may further include a pair of left and right regulating members configured to regulate respective sides of the storage bag held by each holding member, and the distance between the holding members when holding the storage bag is larger than a distance between the regulating members.

In this case, the surface of each regulating member that faces the respective sides of the storage bag may be inclined with respect to a vertical direction so as to approach each other as a distance from the opening of the storage bag held by the holding members increases.

The sheet handling apparatus of the present invention may further include: a temporary storage unit configured to temporarily hold a sheet to be stored in the storage bag held by the holding members; and a pusher for pushing the sheets held by the temporary storage unit into the inside of the storage bag held by the holding members.

BRIEF DESCRIPTION OF THE DRAWINGS

FIG. 4 is a side view showing an example of a configuration of a banknote storage bag to be held by each holding member of the banknote storage mechanism shown in FIG. 2 and the like.

FIG. 5 is a side view showing another example of a configuration of a banknote storage bag to be held by each holding member of the banknote storage mechanism shown in FIG. 2 and the like.

FIG. 6 is a side view showing still another example of a configuration of a banknote storage bag to be held by each holding member of the banknote storage mechanism shown in FIG. 2 and the like.

FIG. 8 is a side view showing still another example of a configuration of a banknote storage bag to be held by each holding member of the banknote storage mechanism shown in FIG. 2 and the like.

FIG. 9 is a side view showing still another example of a configuration of a banknote storage bag to be held by each holding member of the banknote storage mechanism shown in FIG. 2 and the like.

FIG. 11 is a functional block diagram showing a configuration of a control system of the banknote handling machine shown in FIG. 1 and the like.

DESCRIPTION OF THE PREFERRED EMBODIMENTS

Figure 1:
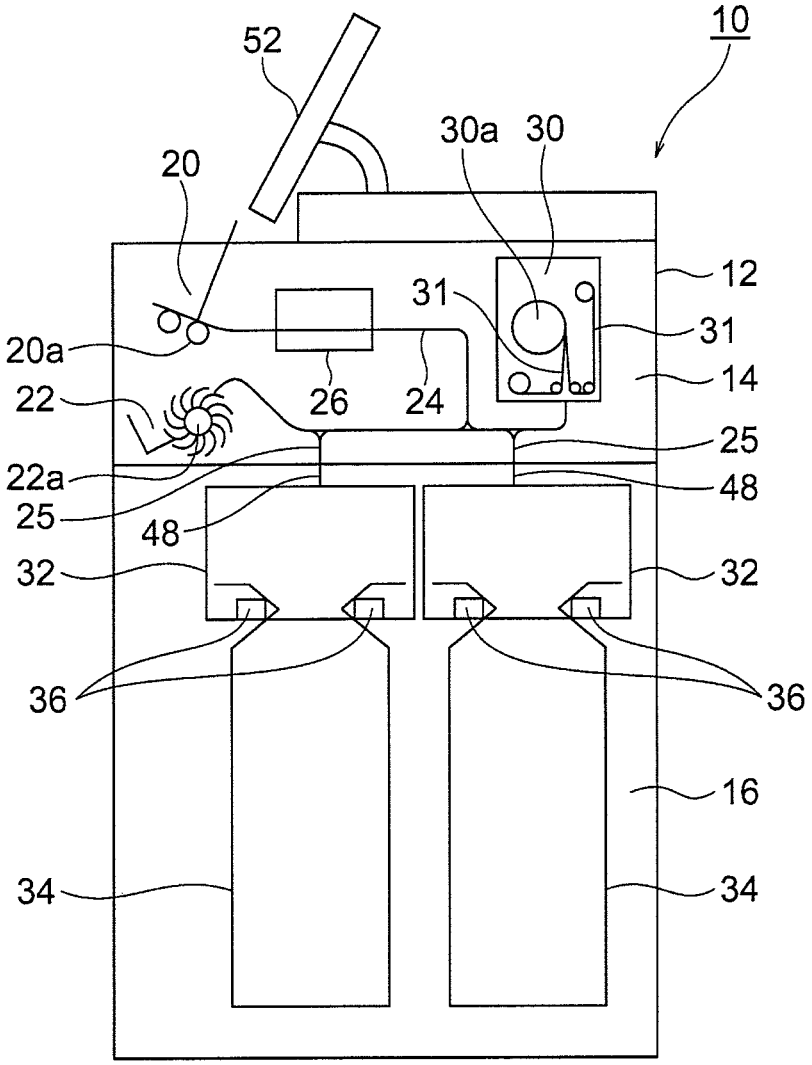
FIG. 1 is a schematic configuration diagram schematically showing an internal configuration of a banknote handling machine according to an embodiment of the present invention.
Figure 2:
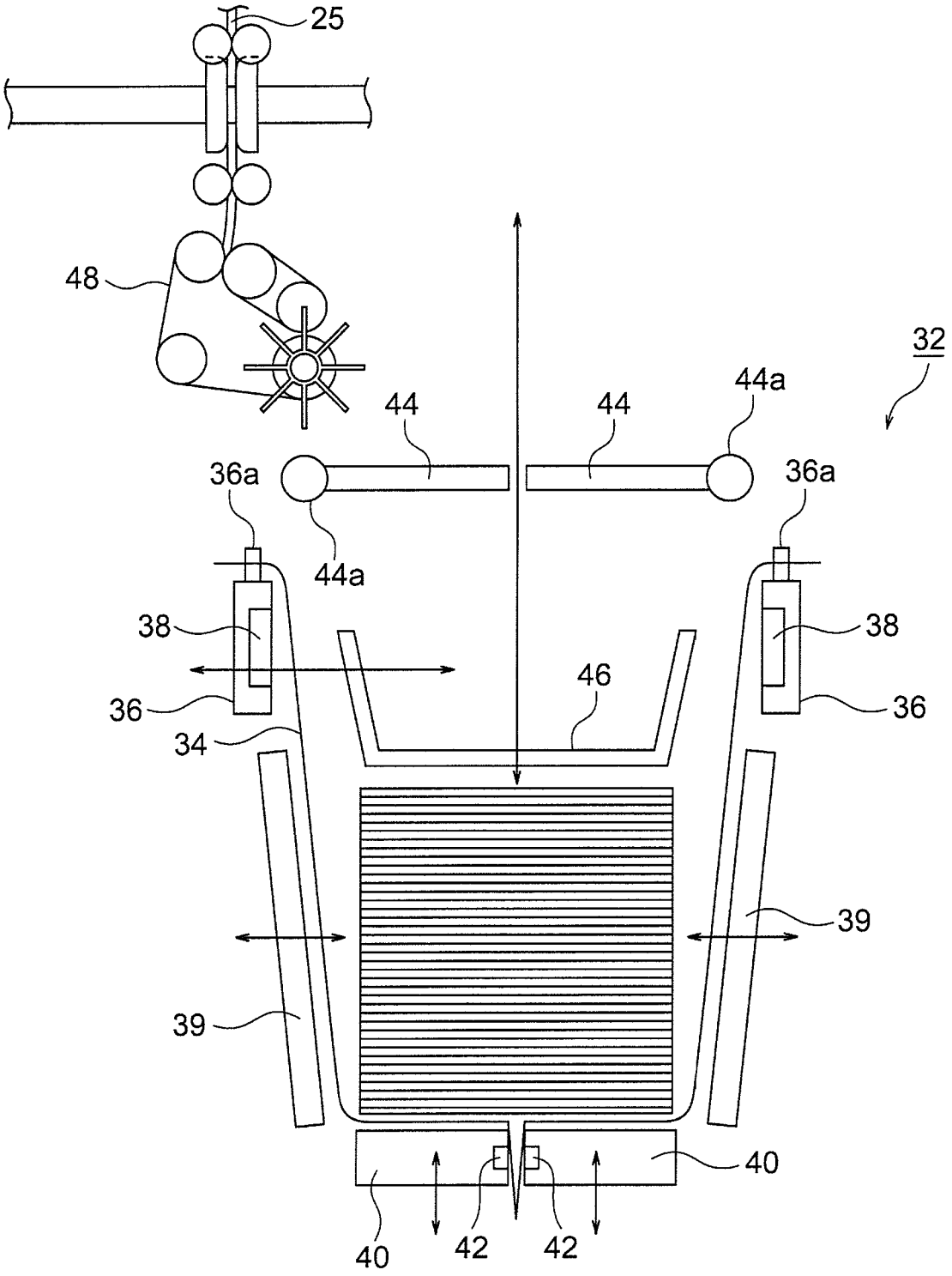
FIG. 2 is a side view showing a detail of a configuration of a banknote storage mechanism in the banknote handling machine shown in FIG. 1.
Figure 3:
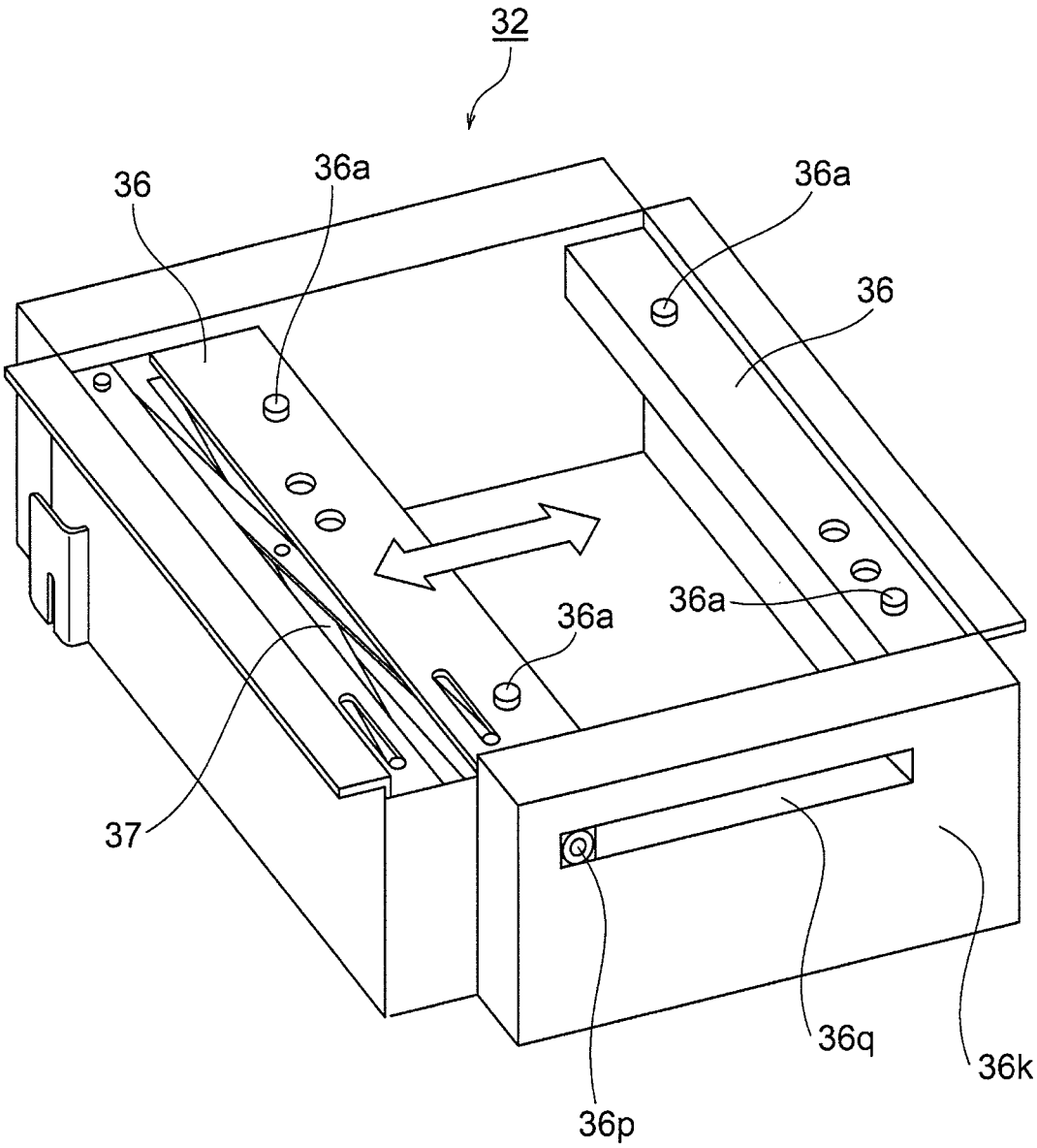
FIG. 3 is a perspective view showing a configuration of a pair of holding members and the like in the banknote storage mechanism shown in FIG. 2.
Figure 10:
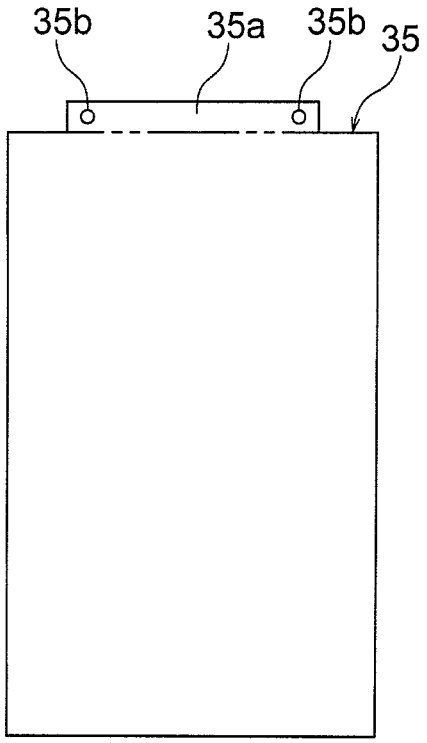
FIG. 10 is a side view showing a configuration of a conventional banknote storage bag.
Figure 11:
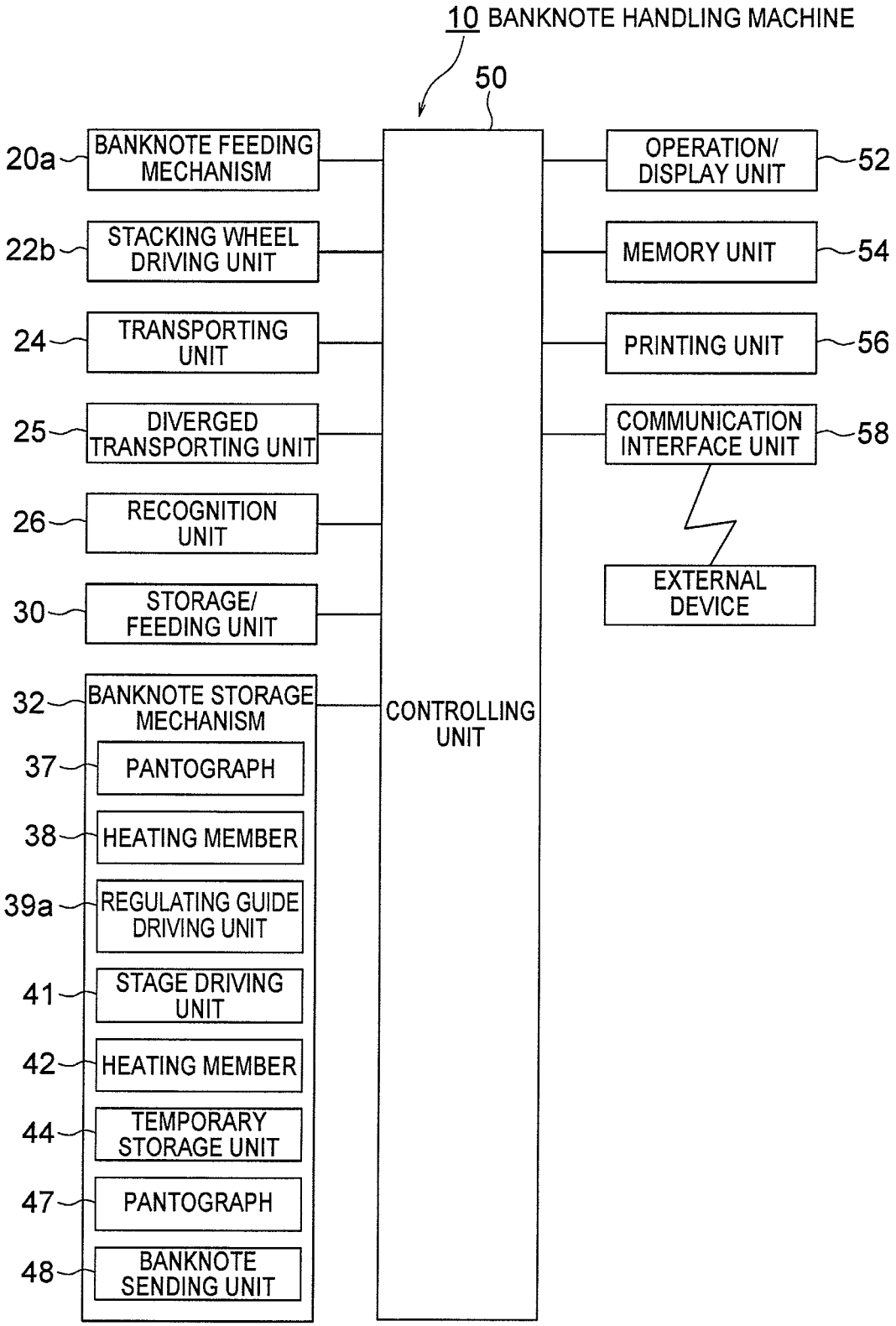

Hereinafter, embodiments of the present invention will be described with reference to the drawings. FIGS. 1 to 11 are diagrams showing a banknote handling machine according to the present embodiment and a banknote storage bag mounted to a mounting unit of such a banknote handling machine. Among these diagrams, FIG. 1 is a schematic configuration diagram schematically showing an internal configuration of the banknote handling machine according to the present embodiment, FIG. 2 is a side view showing a detail of a configuration of a banknote storage mechanism in the banknote handling machine shown in FIG. 1, and FIG. 3 is a perspective view showing a configuration of a pair of holding members and the like in the banknote storage mechanism shown in FIG. 2. FIGS. 4 to 9 are side views showing various examples of configurations of banknote storage bag to be held by each holding member of the banknote storage mechanism shown in FIG. 2 and the like. Note that FIG. 10 is a side view showing a configuration of a conventional banknote storage bag. Further, FIG. 11 is a functional block diagram showing a configuration of a control system of the banknote handling machine shown in FIG. 1 and the like.

A banknote handling machine 10 according to the present embodiment is generally installed in a front office area or back office area of a store such as a supermarket, or placed in a lobby of a bank or an inside of the bank, and the banknote handling machine 10 can perform various processes such as deposit processing of banknotes. As shown in FIG. 1, the banknote handling machine 10 according to the present embodiment has a substantially rectangular parallelepiped housing 12. A left side surface of the housing 12 in FIG. 1 is a front surface of the housing 12 (that is, the surface facing an operator). An upper assembly 14 and a lower assembly 16 are arranged inside the housing 12 such that the upper assembly 14 and the lower assembly 16 can be respectively drawn forward from the front surface of the housing 12 (specifically, to the left in FIG. 1). In the upper assembly 14, an inlet unit 20 such as a hopper for taking in the banknotes from outside into inside the housing 12 is disposed at an upper part of the front surface of the housing 12 (the upper part of the left side surface in FIG. 1). Further, in the upper assembly 14, an outlet 22 for feeding out the banknotes from inside the housing 12 to outside is disposed below the inlet unit 20 in the front surface of the housing 12 (the surface on the left side in FIG. 1).

The inlet unit 20 is provided with a banknote feeding mechanism 20*a* for feeding the banknotes, placed on the inlet unit 20 in a stacked state by the operator, one by one into the housing 12. A transporting unit 24 for transporting the banknotes one by one in the housing 12 is disposed in the upper assembly 14 in the housing 12 of the banknote handling machine 10. The banknotes fed out from the inlet unit 20 by the banknote feeding mechanism 20*a* are transported one by one by the transporting unit 24. The transporting unit 24 is provided with a recognition unit 26. Each banknote fed out to the transporting unit 24 by the banknote feeding mechanism 20*a* is recognized by the recognition unit 26 for the denomination, authenticity, front/back, fitness, new/old, transportation state, and the like.

As shown in FIG. 1, the outlet 22 is connected to the transporting unit 24, and the banknote sent from the transporting unit 24 to the outlet 22 is stacked in the outlet 22. The outlet 22 is accessible from outside the housing 12 so that the operator can take out the banknotes stacked in the outlet 22 from the front surface of the housing 12. A stacking wheel 22*a* is disposed at a connection point between the transporting unit 24 and the outlet 22, and the stacking wheel 22*a* is adapted to rotate in a counterclockwise direction in FIG. 1. When the banknote is sent from the transporting unit 24 to the outlet 22, the stacking wheel 22*a* rotates in the counterclockwise direction in FIG. 1 in a state in which the banknote is held between two blades of the stacking wheel 22*a*. Then, the banknote held between the two blades of the stacking wheel 22*a* is stacked in the outlet 22 in an aligned state.

In the upper assembly 14, the transporting unit 24 is provided with a tape-type storage/feeding unit 30. The banknote sent from the transporting unit 24 to the storage/feeding unit 30 is stored in the storage/feeding unit 30 and the banknotes stored in the storage/feeding unit 30 can be fed out one by one to the transporting unit 24. More specifically, the storage/feeding unit 30 is provided with a drum 30*a* rotatable in both forward and reverse directions, and one end of a pair of band-shaped tapes 31 is connected to an outer peripheral surface of the drum 30*a*. When the banknote is sent from the transporting unit 24 to the storage/feeding unit 30, the banknote is wound on the drum 30*a* by each band-shaped tape 31 such that the banknote and each tape 31 are integrally wound on the drum 30*a*. On the other hand, when each tape 31 is rewound from the drum 30*a* by rotating the drum 30*a* in the reverse direction, the banknote wound on the drum 30*a* is discharged from each tape 31 and is fed out to the transporting unit 24.

As shown in FIG. 1, in the present embodiment, a plurality of (for example, two) banknote storage mechanisms 32 is provided in the lower assembly 16 to store banknotes inside a banknote storage bag 34 having an opening on one side. Each banknote storage mechanism 32 is provided with a pair of holding members 36 which space apart from each other and face each other. Two portions of the banknote storage bag 34, facing each other in the vicinity of the opening of the banknote storage bag 34, are held by the pair of holding members 36, respectively. One holding member 36 (For example, the holding member 36 on the right side in FIGS. 1 and 2) is fixed in a fixed position and does not move from the fixed position. In contrast, the other holding member 36 (For example, the holding member 36 on the left side in FIGS. 1 and 2) can move towards the one holding member 36 fixed in the fixed position. As shown in FIG. 2, each holding member 36 is provided with a heating member 38. After a predetermined amount of the banknotes are stored in the banknote storage bag 34 held by the holding members 36 in the banknote storage mechanism 32, before the banknote storage bag 34 is taken out from the banknote storage mechanism 32, the one holding member 36 moves toward the other holding member 36. Then, the two holding members 36 are in contact with each other via the banknote storage bag 34, and the heating members 38 heat the portion near the opening of the banknote storage bag 34. As a result, the opening of the banknote storage bag 34 is sealed by heat. In the banknote storage mechanism 32, instead of moving the one holding members 36 of the pair of holding members 36 towards the other holding member 36, both holding members 36 may be moved to a center position towards each other so that the two holding members 36 touch each other in the center position.

A plurality (two in the example shown in FIG. 1) of diverged transporting units 25, corresponding to the banknote storage mechanisms 32 respectively, diverge from the transporting unit 24 in the upper assembly 14. The banknotes transported from the transporting unit 24 to the diverged transporting units 25 are sent from the diverged transporting units 25 to the banknote storage bags 34 mounted to the banknote storage mechanisms 32 respectively, and stored in the banknote storage bags 34.

Next, the configuration of the banknote storage mechanism 32 in the present embodiment will be described in detail with reference to FIGS. 2 and 3. FIG. 2 is a side view showing details of the configuration of the banknote storage mechanism 32, and FIG. 3 is a perspective view showing a configuration of a pair of holding members 36 and the like in the banknote storage mechanism 32 shown in FIG. 2.

As shown in FIG. 2, the banknote storage mechanism 32 is provided with a banknote sending unit 48, temporary storage unit 44, and stages 40. The banknotes are transported from the diverged transporting unit 25 of the upper assembly 14 to the banknote sending unit 48 located in the lower assembly 16, and then, sent to the banknote storage bag 34 held by the pair of holding members 36. The banknotes sent from the banknote sending unit 48 are temporarily stored on the temporary storage unit 44. The bottom of the banknote storage bag 34 held by the pair of holding members 36 is placed on the stage 40.

As shown in FIG. 2, the banknote sending unit 48 is a combination of roller and belt. The banknotes are transported from the diverged transporting unit 25 of the upper assembly 14 to the banknote sending unit 48 of the lower assembly 16. Then, the banknotes transported to the banknote sending unit 48 are sent onto the temporary storage unit 44 one by one, and then stacked on the temporary storage unit 44. The temporary storage unit 44 consists of a pair of left and right. Each temporary storage unit 44 can rotate downward (that is, in the direction of the arrow in FIG. 2) around a shaft 44*a* provided at the base end portion of each temporary storage unit 44. The stage 40 consists of a pair of left and right. Each stage 40 is movable in the vertical direction and the lateral direction in FIG. 2. A gap is formed between the pair of stages 40, and a part of the banknote storage bag 34 held by the holding members 36 extends downward from each stage 40 through the gap. Note that each stage 40 is driven by a stage driving unit 41 (see FIG. 11) such as an electric actuator.

As shown in FIG. 2, each stage 40 is provided with a heating member 42, respectively. Before the banknote storage bag 34 is taken out from the banknote storage mechanism 32, one stage 40 (for example, the stage 40 on the left side in FIG. 2) is moved toward the other stage 40 (for example, the stage 40 on the right side in FIG. 2) and the stages 40 are in contact with each other via the banknote storage bag 34. Then, the heating members 42 heat a bottom portion of the banknote storage bag 34 storing the banknotes therein, and the bottom portion of the banknote storage bag 34 is sealed by heat. In the banknote storage mechanism 32, instead of moving the one stage 40 of the pair of stages 40 towards the other stage 40, both stages 40 may move towards each other to the center position and the stages 40 may be in contact with each other at the center position.

As shown in FIG. 3, a pantograph 37 is mounted to the left holding member 36 of the pair of left and right holding members 36. When the left holding member 36 is moved by the pantograph 37 toward the right holding member 36, the pair of holding members 36 are in contact with each other. More specifically, a guide pin 36*p* is disposed at an end of the left holding member 36. In addition, a linear long hole 36*q* for guiding the guide pin 36*p* is formed in a frame 36*k* for supporting each holding member 36. Note that the long hole 36*q* is formed so as to extend in a horizontal direction in the frame 36*k*. When the pantograph 37 expands, the guide pin 36*p* disposed at the left holding member 36 is guided along the long hole 36*q*, whereby the left holding member 36 is moved toward the right holding member 36.

Figure 4:
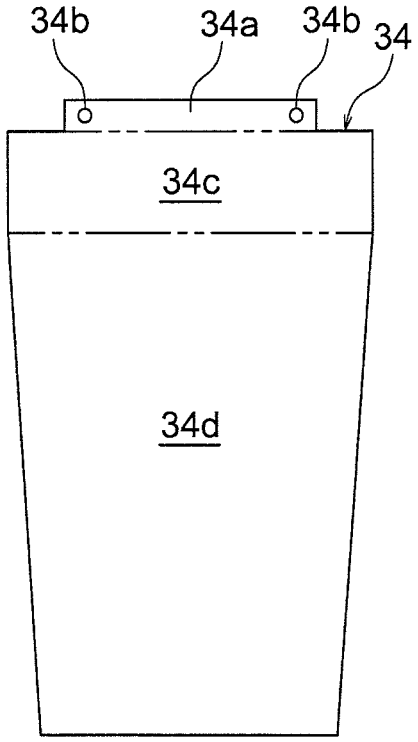
Figure 5:
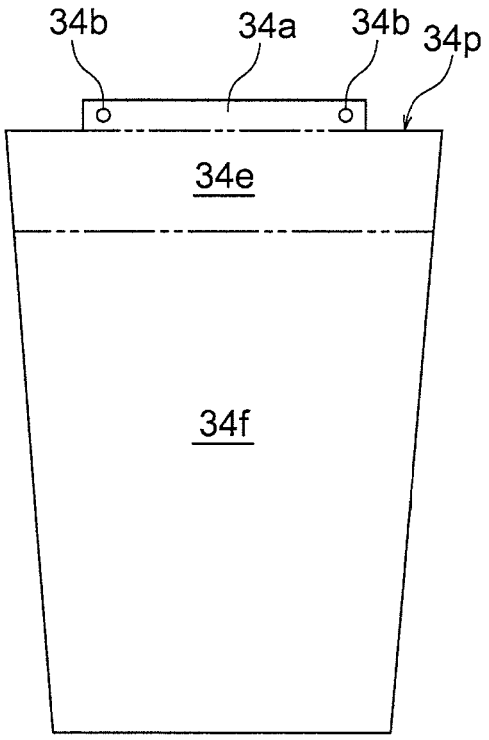

Further, as shown in FIG. 3, two pin 36*a* are respectively disposed on upper surfaces of the pair of left and right holding members 36. As shown in FIG. 4, a pair of protrusions 34*a* each having two openings 34*b* are disposed at a location near the opening of the banknote storage bag 34 to be held by the holding members 36 (that is, an upper end of the banknote storage bag 34). When the banknote storage bag 34 is held by the holding members 36, each pin 36*a* of each holding member 36 passes through each opening 34*b* formed in each protrusion 34*a* of the banknote storage bag 34. As a result, these protrusions 34*a* are held by the holding members 36.

As shown in FIG. 2, a pusher plate 46 is disposed above the pair of the temporary storage units 44. The pusher plate 46 is provided with a pantograph 47 (see FIG. 11, not shown in FIG. 2), and the pusher plate 46 can be moved in the vertical direction within a range indicated by the arrow in FIG. 2 by the pantograph 47 expanding and contracting in the vertical direction in FIG. 2. When the banknotes temporarily held on the temporary storage unit 44 are stored in the banknote storage bag 34, by moving the pusher plate 46 downward, it is possible to push the banknotes remaining on the temporary storage units 44 toward the banknote storage bag 34.

Below each holding member 36, a pair of regulating guides 39 is provided outside of each stage 40. Each regulating guide 39 is movable in directions toward and away from each other. That is, each regulating guide 39 can move in the lateral direction in FIG. 2. These regulating guides 39 regulate respective sides of the banknote storage bag 34 when many banknotes are stored in the banknote storage bag 34 held by each holding member 36. Each regulating guide 39 is moved in the lateral direction in FIG. 2 by a regulating guide driving unit 39*a* (see FIG. 11) including a pantograph, an electric actuator, or the like.

Each regulating guide 39 has a plate shape having a large lateral width corresponding to a lateral width of the banknote storage bag 34. It is noted that each regulating guide 39 is not limited to a plate shape having a large lateral width. Each regulating guides 39 may be constituted by arranging a plurality of plate-like members having a small lateral width so as to correspond to the lateral width of the banknote storage bag 34. Alternatively, each regulating guide 39 may be composed of a plurality of rod-like members arranged so as to correspond to the lateral width of the banknote storage bag 34. As described above, each regulating guide 39 can be moved in the lateral direction in FIG. 2 by the regulating guide driving unit 39*a*. By moving each regulating guide 39 by the regulating guide driving unit 39*a*, the distance between the opposing left and right regulating guides 39 is adjusted according to the width of the banknote stored in the banknote storage bag 34.

In this manner, when many banknotes are stored in the banknote storage bag 34 held by each holding member 36, the respective sides of the banknote storage bag 34 when each stage 40 moves downward are regulated by each regulating guide 39. Thus, even if the height of the banknotes stored in the banknote storage bag 34 increases, it is possible to prevent the banknotes from collapsing in the banknote storage bag 34.

In the example shown in FIG. 2, the surfaces of the regulating guides 39 opposed to the respective sides of the banknote storage bag 34 are inclined with respect to the vertical direction so as to approach each other as a distance from the opening of the banknote storage bag 34 held by each holding member 36 increases (That is, as a distance from the upper end of the banknote storage bag 34 in FIG. 2 increases). In addition, the distance between the regulating guides 39 is smaller than the distance between the holding members 36 when holding the banknote storage bag 34.

In addition to the pair of left and right regulating guides 39, a pair of regulating guides each having a similar configuration as the regulating guide 39 may be provided on the near side and the far side of the banknote storage bag 34 on the page of FIG. 2. In this case, the entire circumference of the banknote storage bag 34 can be regulated by the regulating guides 39 and the regulating guides provided on the near side and the far side of the banknote storage bag 34. Therefore, it is possible to more reliably prevent the banknotes from collapsing in the banknote storage bag 34.

The dimension of the stage 40 is designed according to the smallest size banknote among various kinds of banknotes to be stored in the banknote storage bag 34. Then, even if the banknote having the smallest size is stored in the banknote storage bag 34, the stage 40 and the regulating guide 39 do not interfere with each other. In the case where a plurality of plate like members having a small lateral width or a plurality of rod-shaped members are arranged side by side as the regulating guide 39, cutouts through which such plate like members or rod-shaped members pass may be provided in the stage 40 so that the stage 40 passes over the regulating guide 39. In this case, the dimension of the stage 40 can be made larger than the width of the banknote. In the present embodiment, the distance between the holding members 36 when holding the banknote storage bag 34 is larger than the width of the stage 40 in the lateral direction in FIG. 2.

Next, details of the configuration of the banknote storage bag 34 which is detachably held by each holding member 36 in the banknote storage mechanism 32 of the banknote handling machine 10 according to the present embodiment will be described with reference to FIG. 4. In the present embodiment, the banknote storage bag 34 is provided with an opening at its upper end edge, and the peripheral length of the internal space is the largest at a position where the opening is provided. Note that the peripheral length of the inner space of the banknote storage bag 34 is approximately the same as the size twice the lateral width of the side surface when no gore is provided in the banknote storage bag 34. On the other hand, when a pair of gores is provided in the banknote storage bag 34, the circumference length of the internal space of the banknote storage bag 34 is as large as total of the size twice the width of the side surface and twice the width of the gore. The banknote storage bag 34 is designed to store a plurality of sheets in a stacked state. Details of the configuration of such a banknote storage bag 34 will be described below.

In the present embodiment, as shown in FIG. 4, the peripheral length of the internal space of the banknote storage bag 34 becomes small as a distance from the opening increases (that is, as going downward in FIG. 4 from the upper end edge of the banknote storage bag 34). More specifically, the lateral width of the side surface of the banknote storage bag 34 is the maximum size at the position where the opening is provided, and the lateral width of the side surface of the banknote storage bag 34 becomes smaller, as a distance from the opening increases. More specifically, the banknote storage bag 34 includes a reinforcing member 34*c* provided in the vicinity of the opening, and a tapered part 34*d* which is provided on the side farther from the opening than the reinforcing member 34*c* and whose peripheral length decreases as a distance from the opening increases. The reinforcing member 34*c* is provided on the front surface side and the back surface side of the banknote storage bag 34. The peripheral length of the inner space of the banknote storage bag 34 is the same length at the position where each reinforcing member 34*c* is provided. Each reinforcing member 34*c* is provided with the protrusion 34*a* formed with two openings 34*b*. When the banknote storage bag 34 is held by each holding member 36, by passing each pin 36*a* of each holding member 36 through each opening 34*b* formed in each protrusion 34*a* of the banknote storage bag 34, these protrusions 34*a* are held by each holding member 36. When the banknote storage bag 34 having such a configuration is used, since the peripheral length of the inner space of the banknote storage bag 34 is the largest size at the position where the opening is provided, the wasted portion of the internal space becomes small in the vicinity of the bottom of the banknote storage bag 34. Therefore, it is possible to prevent the banknotes stored in the banknote storage bag 34 in a stacked state from collapsing. In particular, since the tapered part 34*d* in which the peripheral length of the inner space decreases as a distance from the opening increases, it is possible to further securely prevent the banknotes stored in a stacked state inside the tapered part 34*d* from collapsing.

Note that the banknote storage bag detachably held by each holding member 36 in the banknote storage mechanism 32 of the banknote handling machine 10 according to the present embodiment is not limited to the configuration shown in FIG. 4. In the present embodiment, a banknote storage bag having a configuration other than the banknote storage bag 34 shown in FIG. 4 may be used, if the opening is provided at the upper end edge and the peripheral length of the inner space is the largest size at the position where the opening is provided. For example, a banknote storage bag 34*p* shown in FIG. 5 may be used. Specifically, in each of a reinforcing member 34*e* and a tapered part 34*f* of the banknote storage bag 34*p*, the peripheral length of the inner space becomes gradually smaller as a distance from the opening increases.

Figure 6:
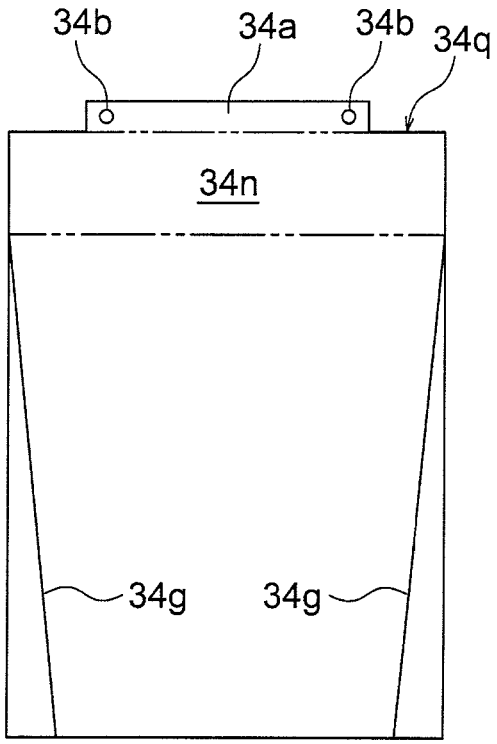
Figure 7:
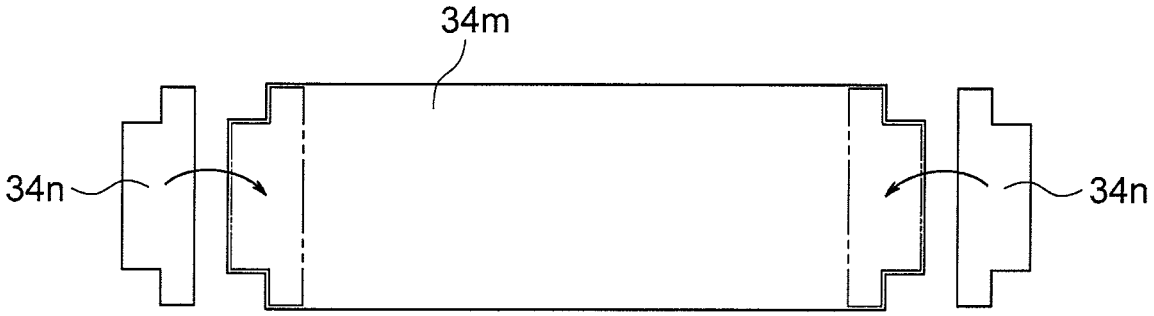
FIG. 7 is an explanatory diagram showing a method of forming the banknote storage bag shown in FIG. 6.

Further, as a still another example of the banknote storage bag detachably held by each holding member 36 in the banknote storage mechanism 32 of the banknote handling machine 10 of the present embodiment, one having a configuration as shown in FIG. 6 may be used. Similar to the banknote storage bag 34 shown in FIG. 4, a banknote storage bag 34*q* shown in FIG. 6 has a smaller peripheral length of the inner space as a distance from the opening increases (that is, as going downward in FIG. 6 from the top edge of the banknote storage bag 34*q*). More specifically, the lateral width of the side surface of the banknote storage bag 34*q* is the maximum size at the position where the opening is provided, and the lateral width of the side surface becomes smaller as a distance from the opening increases. More specifically, as shown in FIG. 6, the banknote storage bag 34*q* has a substantially rectangular shape, and an inner space is formed by adhering the inner surface of the portion near the side edge of the banknote storage bag 34*q*. A pair of right and left adhered parts on the inner surface of the banknote storage bag 34*q* is indicated by reference numeral 34*g*. As shown in FIG. 6, the pair of right and left adhered parts 34*g* on the inner surface of the banknote storage bag 34*q* is inclined with respect to the side edge of the banknote storage bag 34*q* so as to approach each other as a distance from the opening increases. As a result, the lateral width of the side surface of the banknote storage bag 34*q* becomes smaller as a distance from the opening increases. A method of forming such a banknote storage bag 34*q* will be described with reference to FIG. 7. As shown in FIG. 7, firstly, an oblong approximately rectangular shaped bag material 34*m* is prepared, and reinforcing members 34*n* are mounted to both ends of such a bag material 34*m* by heat sealing, for example. Thereafter, the bag material 34*m* is folded about a two-dot chain line extending in the vertical direction in FIG. 7, and the left and right bag materials 34*m* face each other. Thereafter, the inner surface of a portion in the vicinity of the side edge of the folded bag material 34*m* is adhered at a position indicated by the reference numeral 34*g* in FIG. 6. Finally, two openings 34*b* are formed in the protrusion 34*a* provided in each reinforcing member 34*n*. As a result, the banknote storage bag 34*q* as shown in FIG. 6 is formed.

Figure 8:
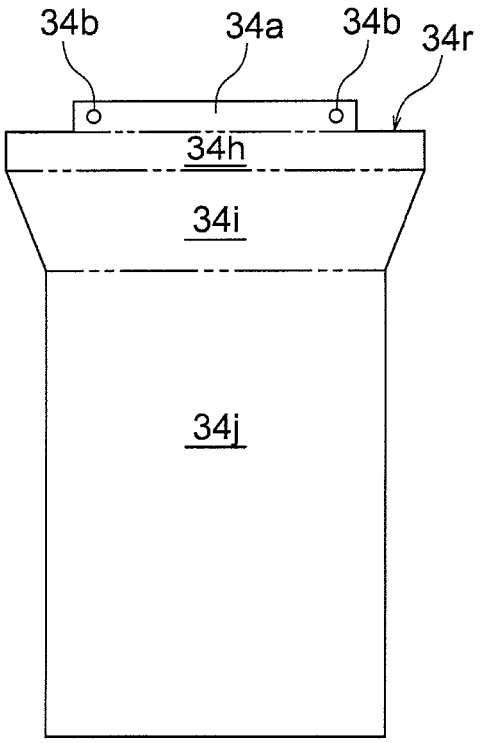

As a still another example of the banknote storage bag detachably held by each holding member 36 in the banknote storage mechanism 32 of the banknote handling machine 10 of the present embodiment, one having a configuration shown in FIG. 8 may be used. Similarly to the banknote storage bag 34 shown in FIG. 4, a banknote storage bag 34*r* shown in FIG. 8 has a smaller peripheral length of the inner space as a distance from the opening increases (that is, as going downward in FIG. 8 from the upper end edge of the banknote storage bag 34*r*). More specifically, the lateral width of the side surface of the banknote storage bag 34*r* is the maximum size at the position where the opening is provided, and the lateral width of the side surface becomes smaller as a distance from the opening increases. More specifically, the banknote storage bag 34*r* includes a reinforcing member 34*h* provided in the vicinity of opening, a first portion 34*i* which is provided on the side close to opening and in which the peripheral length of the inner space decreases as a distance from the opening increases, and a second portion 34*j* which is provided farther from the opening than the first portion 34*i* and in which the peripheral length of the inner space is the same length.

Figure 9:
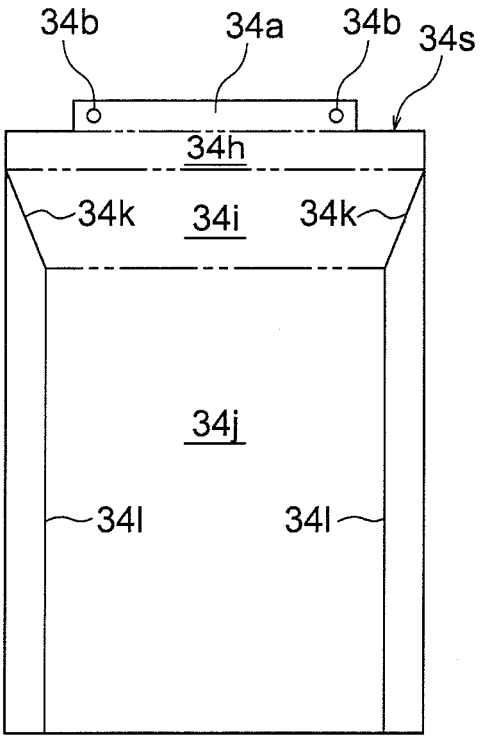

As a still another example of the banknote storage bag detachably held by each holding member 36 in the banknote storage mechanism 32 of the banknote handling machine 10 of the present embodiment, one having a configuration shown in FIG. 9 may be used. Similarly to the banknote storage bag 34 shown in FIG. 4, a banknote storage bag 34*s* shown in FIG. 9 has a smaller peripheral length of the inner space as a distance from the opening increases (that is, as going downward in FIG. 9 from the upper end edge of the banknote storage bag 34*s*). More specifically, the lateral width of the side surface of the banknote storage bag 34*s* is the maximum size at the position where the opening is provided, and the lateral width of the side surface becomes smaller as a distance from the opening increases. More specifically, as shown in FIG. 9, the banknote storage bag 34*s* has a substantially rectangular shape, and an inner space is formed by adhering the inner surface of a portion near the side edge of the banknote storage bag 34*s*. A pair of left and right adhered parts on the inner surface of the banknote storage bag 34*s* is indicated by reference numerals 34*k* and 34*l*. As shown in FIG. 9, in the vicinity of the opening of the banknote storage bag 34*s*, the substantially rectangular reinforcing member 34*h* extending across the entire width direction of the opening is provided. The upper end of the pair of left and right adhered parts 34*k* substantially coincides with the lower edge of the reinforcing member 34*h*. The pair of right and left adhered parts 34*k* is inclined with respect to the side edge of the banknote storage bag 34*s* so as to approach each other as a distance from the opening increases. Thus, in the banknote storage bag 34*s*, the first portion 34*i* is formed between the pair of right and left adhered parts 34*k* and the peripheral length of the inner space of the first portion 34*i* decreases as a distance from the opening increases. The pair of right and left adhered parts 34*l* following the pair of right and left adhered parts 34*k* extends parallel to the side edge of the banknote storage bag 34*s*. The pair of left and right adhered parts 34*l* is positioned farther from the opening than the pair of left and right adhered parts 34*k*, and the lower edge of each adhered part 34*l* substantially coincides with the lower edge of the banknote storage bag 34*s*. Thus, in the banknote storage bag 34*s*, the second portion 34*j* is formed between the pair of left and right adhered parts 34*l*. The second portion 34*j* is provided on the side farther from the opening than the first portion 34*i*, and the peripheral length of the inner space of the second portion 34*j* is the same length. A method of forming such a banknote storage bag 34*s* is substantially the same as the above-described method of forming the banknote storage bag 34*q*.

Similarly to the banknote storage bag 34, the peripheral length of the inner space of each banknote storage bag 34*p*, 34*q*, 34*r*, and 34*s* described above is the largest size at the position where the opening is provided. Therefore, in the vicinity of the bottom portion of each banknote storage bag 34*p*, 34*q*, 34*r*, and 34*s*, the wasted portion of the internal space is reduced, so that it is possible to prevent the banknotes stored in a stacked state from collapsing.

As a comparative example, the configuration of a conventional banknote storage bag is shown in FIG. 10. As shown in FIG. 10, a banknote storage bag 35 having a substantially rectangular shape and having an opening at its upper end has been conventionally used. In such a banknote storage bag 35, the peripheral length of the inner space is the same length at any position along the height direction of the banknote storage bag 35. In the vicinity of the opening of the banknote storage bag 35, reinforcing members are provided on the front surface side and the back surface side, respectively. Each reinforcing member is provided with a pair of protrusions 35*a* formed with two openings 35*b*. When the banknote storage bag 35 is held by each holding member 36, by passing each pin 36*a* of each holding member 36 through each opening 35*b* formed in each protrusion 35*a* of the banknote storage bag 35, these protrusions 35*a* are held by each holding member 36. However, in the case of using the conventional banknote storage bag 35 as shown in FIG. 10, since the lateral width of the side surface is substantially the same size from the opening to the bottom, there was a problem that the banknotes stored in the banknote storage bag 35 in a stacked state tend to collapse. More specifically, in order to reliably store the banknotes in the banknote storage bag 35, it is necessary to make the opening provided at the upper end thereof as large as possible. However, if the size of the opening becomes large, the width of the banknote storage bag 35 also becomes large. If the size of the lateral width of the banknote storage bag 35 is too larger than the length of the banknote in the longitudinal direction, there is a fear that the banknotes collapse inside the banknote storage bag 35 when a plurality of banknotes are stored in the storage bag in a stacked state. On the other hand, in the case of using the banknote storage bags 34*p*, 34*q*, 34*r*, and 34*s* described above, the peripheral length of the inner space becomes smaller as a distance from the opening increases, so it is possible to prevent the occurrence of such a problem.

The banknote handling machine 10 of the present embodiment comprises a controlling unit 50 for controlling components of the banknote handling machine 10. More specifically, as shown in FIG. 11, the controlling unit 50 is connected to the components such as the banknote feeding mechanism 20*a* disposed in the inlet unit 20, a stacking wheel driving unit 22*b* for driving the stacking wheel 22*a* disposed in the outlet 22, the transporting unit 24, the diverged transporting unit 25, the recognition unit 26, the storage/feeding unit 30, the banknote storage mechanism 32 including the pantograph 37, the heating member 38, the regulating guide driving unit 39*a*, the stage driving unit 41, the heating member 42, the temporary storage unit 44, the pantograph 47 and the banknote sending unit 48. A signal relating to a recognition result of each banknote by the recognition unit 26 is sent to the controlling unit 50, and the controlling unit 50 controls the operation of the components by sending command signals to the components of the banknote handling machine 10, respectively.

In addition, as shown in FIG. 11, an operation/display unit 52, a memory unit 54, a printing unit 56, and a communication interface unit 58 are respectively connected to the controlling unit 50. As shown in FIG. 1, the operation/display unit 52 is, for example, a touch panel or the like disposed on the upper surface of the housing 12, and information on processing state such as deposit processing of the banknotes in the banknote handling machine 10, information on the inventory amount of the banknotes stored in each banknote storage bag 34 and the like are displayed on the operation/display unit 52. Further, the operator can give various instructions to the controlling unit 50 by operating the operation/display unit 52. The memory unit 54 memorizes processing history such as deposit processing of the banknotes in the banknote handling machine 10 and information on the inventory amount of the banknotes stored in each banknote storage bag 34. The printing unit 56 prints processing history such as deposit processing of the banknotes in the banknote handling machine 10 and information on the inventory amount of the banknotes stored in each banknote storage bag 34 on a receipt or the like. The controlling unit 50 sends and receives signals to and from an external device disposed separately from the banknote handling machine 10 according to the present embodiment (for example, an upper terminal) via the communication interface unit 58. Specifically, the controlling unit 50 can send the information stored in the memory unit 54 to the external device disposed separately from the banknote handling machine 10 via the communication interface unit 58. For example, when security guards of a cash-in-transit company collect banknotes together with the banknote storage bag 34, information on the collected banknotes is transmitted to the computer of the cash-in-transit company by the communication interface unit 58.

Next, an operation of the banknote handling machine 10 having such a configuration will be described. Note that the operation of the banknote handling machine 10 as shown below is performed by the controlling unit 50 controlling each component of the banknote handling machine 10.

First, the operation on which deposit processing of the banknotes is performed in the banknote handling machine 10 will be described. After the operator puts the banknotes into the inlet unit 20, the operator gives a command of starting deposit processing to the controlling unit 50 through the operation/display unit 52. Then, the banknotes put into the inlet unit 20 are fed out one by one into the housing 12 by the banknote feeding mechanism 20*a* and are transported one by one by the transporting unit 24. Each banknote transported by the transporting unit 24 is recognized by the recognition unit 26 for the denomination, authenticity, front/back, fitness, new/old, transportation state, and the like. The banknote recognized as not being a normal banknote by the recognition unit 26, namely a reject banknote, is sent to the outlet 22 by the transporting unit 24 and stacked in the outlet 22. Accordingly, the operator can manually take out the reject banknote stacked in the outlet 22 from the front surface of the housing 12 and reinsert it into the inlet unit 20. On the other hand, the banknote recognized by the recognition unit 26 as being a normal banknote is sent from the transporting unit 24 to the diverged transporting unit 25, and then the banknote is sent from the diverged transporting unit 25 to the banknote storage bag 34 and stored therein.

If the banknote storage bag 34 to which the banknotes recognized by the recognition unit 26 are to be sent is in a full state or a near full state and the banknote storage bag 34 can not store the banknotes any more, the banknotes recognized by the recognition unit 26 are sent to the storage/feeding unit 30 and stored in the storage/feeding unit 30. Then, after the banknote storage bag 34 in the full state or the near full state is taken out from the banknote storage mechanism 32 of the lower assembly 16 by the security guard of the cash-in-transit company or the clerk of the store and then an empty banknote storage bag 34 is mounted to the banknote storage mechanism 32, the banknotes are fed out one by one from the storage/feeding unit 30 to the transporting unit 24 and sent to the banknote storage bag 34 by the transporting unit 24.

Next, in each banknote storage mechanism 32, an operation when storing the banknotes, sent from the diverged transporting unit 25 of the upper assembly 14 to the lower assembly 16, in the banknote storage bag 34 held by the pair of holding members 36 will be described.

The banknotes sent from the diverged transporting unit 25 of the upper assembly 14 to the lower assembly 16 are sent by the banknote sending unit 48 onto the pair of the temporary storage units 44 and are stacked on the temporary storage units 44. Then, when a predetermined number of banknotes are stacked on the temporary storage units 44, as each temporary storage unit 44 rotates around the shaft 44*a* provided at the proximal end portion thereof downwardly (that is, in the direction of the arrow in FIG. 2), the banknotes stacked on the temporary storage units 44 fall from the temporary storage units 44 due to their own weight and are stored in the banknote storage bag 34. When the banknotes fall from the temporary storage units 44 and are stored in the banknote storage bag 34, each stage 40 is moved downward by the stage driving unit 41. By this way, a storage space of the banknotes, sent from the temporary storage unit 44 to the banknote storage bag 34 next time, is formed inside the banknote storage bag 34. Further, in the present embodiment, when the banknotes are sent to the inside of the banknote storage bag 34 held by each holding member 36 and stored in the banknote storage bag 34, the controlling unit 50 controls the pantograph 47 so as to push the banknotes held on the temporary storage units 44 into the banknote storage bag 34 by the pusher plate 46. As a result, even if the banknotes remain on the temporary storage units 44, such remaining banknotes can be dropped from the temporary storage units 44 and stored in the banknote storage bag 34.

Further, after the banknotes are stored in the banknote storage bag 34 held by each holding member 36 and each stage 40 is moved downward, the controlling unit 50 may control the pantograph 47 so as to bring the pusher plate 46 into the banknote storage bag 34 and press the bottom of the banknote storage bag 34 toward each stage 40 via the banknotes stored in the banknote storage bag 34. In this case, by pushing the banknotes into the banknote storage bag 34 by the pusher plate 46, the banknotes stored in a stacked state inside the banknote storage bag 34 are compressed in the stacking direction. Therefore, it is possible to further prevent the banknotes stored in the banknote storage bag 34 from collapsing.

According to the banknote storage bags 34, 34*p*, 34*q*, 34*r* and 34*s* of the present embodiment having the above-described configuration, the opening is provided at the upper end edge, and the peripheral length of the inner space is the largest size at the position where the opening is provided. As described above, note that the peripheral length of the inner space of the banknote storage bag 34, 34*p*, 34*q*, 34*r* and 34*s* is approximately the same as the size twice the lateral width of the side surface when no gore is provided. On the other hand, when a pair of gores is provided in the banknote storage bag 34, 34*p*, 34*q*, 34*r* and 34*s*, the circumference length of the internal space of the banknote storage bag 34, 34*p*, 34*q*, 34*r* and 34*s* is as large as total of the size twice the width of the side surface and twice the width of the gore. In the banknote storage bag 34, 34*p*, 34*q*, 34*r* and 34*s* of the present embodiment, a plurality of banknotes are stored in a stacked state. If the peripheral length of the inner space of the banknote storage bag 34, 34*p*, 34*q*, 34*r* and 34*s* is the largest size at the position where the opening is provided, the wasted portion of the internal space becomes small in the vicinity of the bottom of the banknote storage bag 34, 34*p*, 34*q*, 34*r* and 34*s*. Therefore, it is possible to prevent the banknotes stored in a stacked state from collapsing.

In the banknote storage bag 34, 34*p*, 34*q*, 34*r* and 34*s* of the present embodiment, as described above, the peripheral length of the inner space decreases as a distance from the opening increases. In addition, the lateral width of the side surface is the maximum size at the position where the opening is provided, and the lateral width of the side surface decreases as a distance from the opening increases.

In the banknote storage bag 34, 34*q*, 34*r* and 34*s* of the present embodiment, as described above, the reinforcing member 34*c*, 34*n* and 34*h* for reinforcing the side surface of the banknote storage bag 34, 34*q*, 34*r* and 34*s* is provided in the vicinity of the opening as described above. The peripheral length of the inner space is the same length at the position where the reinforcing member 34*c*, 34*n*, 34*h* is provided.

In the banknote storage bag 34*q* and 34*s* of the present embodiment, as described above, the banknote storage bag 34*q* and 34*s* has a substantially rectangular shape, and an inner space is formed by adhering the inner surface of the portion near the side edge of the banknote storage bag 34*q* and 34*s*.

Further, as described above, each of the banknote storage bag 34*r* and 34*s* of the present embodiment includes the first portion 34*i* which is provided on the side close to the opening and in which the peripheral length of the inner space decreases as a distance from the opening increases, and the second portion 34*j* which is provided on the side farther from the opening than the first portion 34*i* and in which the peripheral length of the inner space is the same length.

The banknote handling machine 10 (sheet handling apparatus) of the present embodiment, in which the banknote storage bag 34 described above is detachably mounted, includes the pair of right and left holding members 36 for holding a portion of the banknote storage bag 34 in the vicinity of the opening in the banknote storage bag 34, and the stage 40 (platform) which is movable in a substantially vertical direction and at least part of the banknote storage bag 34 held by the holding member 36 is placed thereon. In addition, the distance between the holding members 36 when holding the banknote storage bag 34 is larger than the width of the stage 40. In this case, even if the peripheral length of the inner space of the banknote storage bag 34 is the maximum size at the opening, the banknote storage bag 34, at least a part of which is placed on the stage 40, can be reliably held by each holding member 36.

Further, in the banknote handling machine 10 (sheet handling apparatus) of the present embodiment, the pair of left and right regulating guides 39 (regulating member) for regulating the respective sides of the banknote storage bag 34 held by each holding member 36 is provided. In addition, the distance between the holding members 36 when holding the banknote storage bag 34 is larger than the distance between the regulating guides 39.

In this case, even if the peripheral length of the inner space of the banknote storage bag 34 is the largest size at the position where the opening is provided, it is possible to reliably hold the banknote storage bag 34, whose sides are regulated by each regulating guide 39, by each holding member 36. Further, the surface of each regulating guide 39 facing the respective sides of the banknote storage bag 34 is inclined with respect to the vertical direction to approach each other as a distance from the opening of the banknote storage bag 34 held by each holding member 36 increases. In this case, the side edge of the tapered part 34*d* of the banknote storage bag 34 (that is, the side edge which is inclined with respect to the banknote stacking direction) can be reliably regulated by each regulating guide 39.

In addition, the banknote handling machine 10 (sheet handling apparatus) of the present embodiment includes a temporary storage unit 44 for temporarily holding banknotes to be stored in the banknote storage bag 34 held by the holding member 36, and the pusher plate 46 (pusher) which pushes the banknotes held by the temporary storage unit 44 into the banknote storage bag 34 held by each holding member 36, respectively. In this case, by pushing the banknotes into the banknote storage bag 34 by the pusher plate 46, the banknotes stored inside the banknote storage bag 34 in a stacked state are compressed in the stacking direction. Therefore, it is possible to further prevent the banknotes stored in the banknote storage bag 34 from collapsing.

It should be noted that the banknote storage bag according to the present embodiment and the banknote handling machine to which such a banknote storage bag can be detachably mounted are not limited to the above described aspects, and various modifications can be conducted.

For example, the banknote storage bag according to the present embodiment is not limited to the one shown in FIGS. 4 to 9. As the banknote storage bag according to the present embodiment, if the opening is provided at the upper end edge and the peripheral length of the inner space is the maximum size at the position where the opening is provided, a banknote storage bag having a configuration other than the shape as shown in FIGS. 4 to 9 may be used.

Further, the storage bag according to the present invention is not limited to a banknote storage bag for storing the banknotes. As a storage bag according to the present invention, a storage bag that stores sheets (for example, checks, vouchers, and the like) other than the banknotes may be used. Also, the sheet handling apparatus according to the present invention is not limited to the banknote handling machine. An apparatus for handling sheets other than the banknotes can be used as the sheet handling apparatus according to the present invention and a storage bag according to the present invention may be detachably mounted to such a sheet handling apparatus.

The invention claimed is:

1. A storage bag mounted to a sheet handling apparatus and configured to store sheets handled by the sheet handling apparatus comprising:

an upper end at which an opening is provided;

wherein an internal space of the storage bag is formed by adhering an internal surface of a portion near an edge of the storage bag;

a peripheral length of the internal space of the storage bag at a position where the opening is provided is the maximum size, and the peripheral length of the internal space of the storage bag decreases as a distance from the opening increases.

2. The storage bag according to claim 1, wherein a plurality of sheets is stored in the storage bag in a stacked state.

3. The storage bag according to claim 1, wherein a lateral width of a side surface of the storage bag is the maximum size at the position where the opening is provided, and the lateral width of the side surface of the storage bag decreases as a distance from the opening increases.

4. The storage bag according to claim 1, wherein a reinforcing unit for reinforcing a side surface of the storage bag is provided in the vicinity of the opening, and the peripheral length of the internal space at a position where the reinforcing unit is provided is the same length.

5. The storage bag according to claim 1, wherein the storage bag comprises a first portion which is provided on a side close to the opening and the peripheral length of the internal space decreases as a distance from the opening increases, and a second portion which is provided on a side farther from the opening than the first portion and having a constant peripheral length of the internal space.

6. A sheet handling apparatus to which a storage bag is detachably mounted, the storage bag having an upper end at which an opening is provided and a peripheral length of an internal space of the storage bag at a position where the opening is provided is the maximum size, the apparatus comprising:

a pair of left and right holding members configured to hold a portion of the storage bag in the vicinity of the opening; and a platform on which at least a part of the storage bag held by the holding members is placed, the platform being movable in a substantially vertical direction, wherein a distance between the holding members when holding the storage bag is larger than a width of the platform.

7. The sheet handling apparatus according to claim 6, further comprising a pair of left and right regulating members configured to regulate respective sides of the storage bag held by each holding member, wherein the distance between the holding members when holding the storage bag is larger than a distance between the regulating members.

8. The sheet handling apparatus according to claim 7, wherein the surface of each regulating member that faces the respective sides of the storage bag is inclined with respect to a vertical direction so as to approach each other as a distance from the opening of the storage bag held by the holding members increases.

9. The sheet handling apparatus according to claim 6, further comprising:

a temporary storage unit configured to temporarily hold a sheet to be stored in the storage bag held by the holding members; and a pusher for pushing the sheets held by the temporary storage unit into the inside of the storage bag held by the holding members.

* * * * *